US007310106B2

(12) United States Patent
Cui

(10) Patent No.: US 7,310,106 B2
(45) Date of Patent: Dec. 18, 2007

(54) THERMAL PRINTER AND THERMAL PRINTING METHOD

(75) Inventor: Shengfu Cui, Saitama (JP)

(73) Assignee: Fujifilm Corporation, Tokyo (JP)

( * ) Notice: Subject to any disclaimer, the term of this patent is extended or adjusted under 35 U.S.C. 154(b) by 282 days.

(21) Appl. No.: 11/235,144

(22) Filed: Sep. 27, 2005

(65) Prior Publication Data

US 2006/0066711 A1 Mar. 30, 2006

(30) Foreign Application Priority Data

Sep. 27, 2004 (JP) ..... 2004-280246

(51) Int. Cl.
*B41J 2/36* (2006.01)

(52) U.S. Cl. ..... 347/188; 400/120.09

(58) Field of Classification Search ..... 347/188; 400/120.09

See application file for complete search history.

(56) References Cited

U.S. PATENT DOCUMENTS 6,091,436 A * 7/2000 Kuwabara ..... 347/195
6,704,036 B2 * 3/2004 Hayashi et al. ..... 347/175
6,801,234 B2 * 10/2004 Nishimura ..... 347/175

FOREIGN PATENT DOCUMENTS

JP 2002-67370 A 3/2002

* cited by examiner

*Primary Examiner*—Huan Tran
(74) *Attorney, Agent, or Firm*—Sughrue Mion Pllc.

(57) ABSTRACT

The recording sheet is virtually divided into a recording area and an unrecording area in a main scan direction. Unrecording area printing heat energy is Esi calculated by subtracting printing heat energy Epi for a line to be printed from maximum printing heat energy Epmax for printing each line in the recording area. Common printing heat energy is calculated by dividing the unrecording area printing heat energy Esi by the number of the heating elements in the unrecording area. Virtual image data for each heating element is obtained by counting backward from the common printing heat energy. A recording sheet is printed based on the virtual image data and the real image data. Total printing heat energy is kept constant in each line, and there occurs no printing heat energy fluctuation on printing. Transport load fluctuation due to the printing heat energy fluctuation is suppressed to prevent an uneven density.

10 Claims, 4 Drawing Sheets

THERMAL PRINTER AND THERMAL PRINTING METHOD

BACKGROUND OF THE INVENTION

1. Field of the Invention

The present invention relates to a thermal printer and a thermal printing method for thermally recording an image on a recording sheet with a thermal head.

2. Background Arts

A direct thermal printer including a thermal head which thermally records an image by coloring onto a thermosensitive recording sheet provided with thermosensitive coloring layers, is known. A plurality of heating elements is aligned on the thermal head in a main scan direction. The direct thermal printer records the image on the recording sheet line by line while relatively moving the thermal head and the recording sheet in a sub scan direction. Each heating element is driven based on image data of one line to apply printing heat energy to the recording sheet.

Friction coefficient between the recording sheet and the thermal head fluctuates according to the printing heat energy. When the printing heat energy is large, the friction coefficient becomes small due to an increase of temperature of the heating elements. When the printing heat energy is small, the friction coefficient becomes large due to a decrease of temperature of the heating elements. Therefore, fluctuation of the friction coefficient becomes large at the portion where density is suddenly changed since fluctuation of the printing heat energy is large. When the friction coefficient fluctuates, transport load of the recording sheet fluctuates, thereby the transporting pitch for the recording sheet changes. There is a problem that the printing heat energy applied to each unit area changes to cause uneven density.

For example, Japanese Patent Laid-Open Publication No. 2002-67370 discloses a direct thermal printer which does not cause uneven density if the transport load fluctuation occurs due to the above change of density. In the direct thermal printer, load of the thermal head is calculated line by line, and the load fluctuation amount is calculated from the difference between the load of the line to be recorded and that of the adjacent line. And the printing heat energy for the line to be recorded is corrected on the basis of the load fluctuation amount. Therefore, even when the transporting pitch for the recording sheet changes due to the transport load fluctuation, the printing heat energy is corrected according to the change thereof, and the uneven density is prevented.

When the printing heat energy is corrected based on the transport load fluctuation, it is necessary to precisely study a relationship between dynamic friction coefficient of each heating element to the recording sheet and the printing heat energy, and a pressure distribution of each heating element to the recording sheet. Thereby, a problem arises in that it is necessary to obtain various data by actually operating each printer, thereby time and labor is required for obtaining data. Moreover, there is a problem that it is impossible to correct the printing heat energy sufficiently even when the printing heat energy is corrected by using the obtained data, since the transport load fluctuation is suppressed by correction of the printing heat energy, not by directly acting on the recording sheet.

SUMMARY OF THE INVENTION

In view of the foregoing, it is an object of the present invention to provide a thermal printer and a thermal printing method for preventing occurrence of uneven density due to transport load fluctuation of a recording sheet.

In order to achieve the above and other objects, the thermal printing method of the present invention divides the heating elements into a first group facing a recording area where said image is recorded and a second group facing an unrecording area where said image is not recorded. The first group is driven on the basis of image data of one line and image of one line is recorded on the recording area. The second group is driven so that total printing heat energy of first printing heat energy generated by the first group and second printing heat energy generated by the second group are approximately made uniform for each line. The first printing heat energy is calculated on the basis of image data of one line. The second printing heat energy is calculated by subtracting the first printing heat energy from the total printing heat energy. The total printing heat energy is equal to or larger than maximum value of the first printing heat energy. The unrecording area is placed at one side or both sides of the recording area. After image recording, the unrecording area is cut off from the recording area.

In the preferred embodiment of the present invention, common printing heat energy is calculated by dividing the second printing heat energy by the number of heating elements of the second group. Next, virtual image data for generating the common printing heat energy is calculated. The heating elements of the second group are driven according to the virtual image data.

In the thermal printer of the present invention, a first calculator, a second calculator and a thermal head driving unit are provided. The first calculator calculates line by line the first energy generated by the first group according to image data of one line. The second calculator calculates line by line the second printing heat energy generated by the second group so that total printing heat energy of the first printing heat energy and the second printing heat energy are approximately made uniform. The thermal head driving unit drives the first group by image data of one line and drives the second group so that the second printing heat energy is generated.

According to the present invention, since the total printing heat energy in each line is kept constant by providing unrecording area at one side or both sides of the recording sheet and by driving heating elements corresponding to both the recording area and the unrecording area with the heating elements corresponding to the recording area, the transport load fluctuation of the recording sheet is prevented. Therefore, it is possible to the control the transport load fluctuation with a simple structure and to prevent occurrence of uneven density and uneven color due to the transport load fluctuation.

BRIEF DESCRIPTION OF THE DRAWINGS

The above objects and advantages of the present invention will become apparent from the following detailed descriptions of the preferred embodiments of the invention when read in conjunction with the accompanying drawings, in which.

DETAILED DESCRIPTION OF THE EMBODIMENTS

Figure 1:
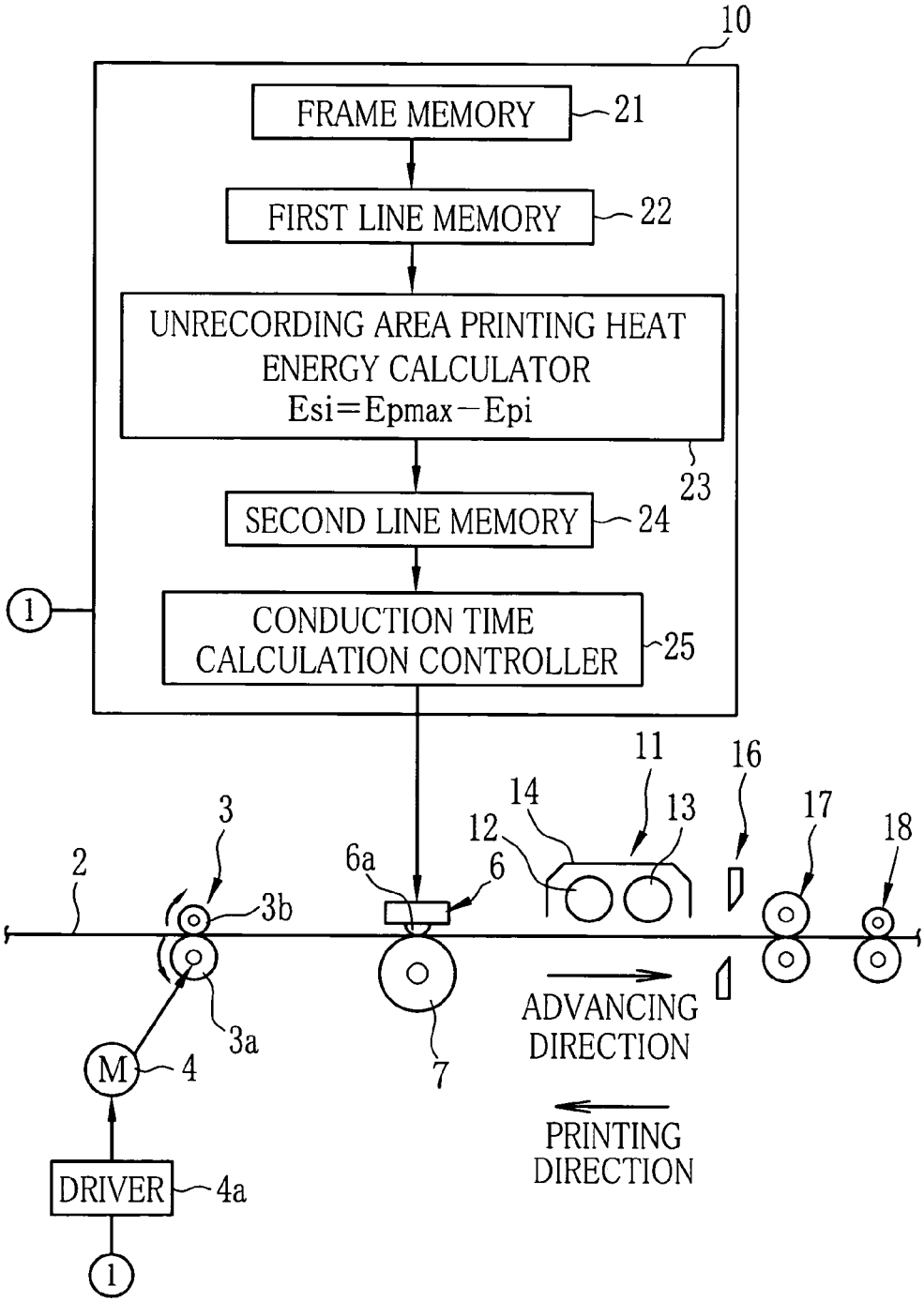
FIG. 1 is a schematic view illustrating a color direct thermal printer according to the present invention.

In FIG. 1, a color direct thermal printer prints an image on a continuous color thermosensitive recording sheet (hereinafter referred to as recording sheet) 2 supplied from a roll (not shown). The recording sheet 2 is transported by a transporting roller pair 3 both in an advancing direction and in a printing direction opposite to the advancing direction. A transporting roller pair 3 includes a capstan roller 3*a* driven by a transport motor 4 and a pinch roller 3*b* movable between the pressing position to the capstan roller 3*a* and the retracted position therefrom. A pulse motor is used for the transport motor 4 and is controlled by a controller 10 through a driver 4*a*.

It is known that the recording sheet 2 includes a cyan thermosensitive coloring layer, a magenta thermosensitive coloring layer and a yellow thermosensitive coloring layer, and a protective layer overlaid on a support in sequence. The yellow thermosensitive coloring layer, a topmost layer is most sensitive to heat among three thermal coloring layers, and is colored yellow with small printing heat energy. The cyan thermosensitive coloring layer, a lowermost layer is least sensitive to heat among three thermal coloring layers, and is colored cyan with large printing heat energy. The yellow thermosensitive coloring layer loses its coloring ability when blue-violet light at 420 nm is irradiated. The magenta thermosensitive coloring layer is colored with medium-heat energy between the yellow and cyan thermosensitive coloring layers and loses its coloring ability when near ultraviolet rays at 365 nm are irradiated.

A thermal head 6 is disposed on the downstream side of the transport roller pair 3 in the advancing direction. The thermal head 6 includes a heating element array 6*a* on which a large number of heating elements 6*b* are aligned.

A platen roller 7 is disposed to face the thermal head 6 so as to pinch the recording sheet 2. The platen roller 7 is movable in the upward and downward directions and biased by a spring (not shown) in the direction for pressing on the thermal head 6.

When the recording sheet 2 is transported in the printing direction by the transporting roller pair 3, the thermal head 6 heats each heating element on the heating element array 6*a* at the temperature according to a printing color and image data to develop colors in the respective thermosensitive coloring layers on the recording sheet 2. The platen roller 7 is descended by a shift mechanism (not shown) with a cam and a solenoid when the recording sheet 2 is supplied or ejected, thereby clearance for passage of the recording sheet 2 is formed between the platen roller 7 and the thermal head 6.

An optical fixing device 11 is disposed to face the recording sheet 2 in the downstream side of the thermal head 6 in the advancing direction. The optical fixing device 11 includes a yellow fixing lamp 12, a magenta fixing lamp 13 and a reflector 14. The yellow fixing lamp 12 radiates blue-violet light having an emission peak at 420 nm, the magenta fixing lamp 13 radiates ultraviolet rays having the emission peak at 365 nm. The yellow and magenta thermosensitive coloring layers on the recording sheet 2 are fixed by radiation of fixing light from the yellow and magenta fixing lamps 12 and 13 so as not to color upon additional heat.

A cutter 16, a slitter 17 and an ejection roller pair 18 are disposed downstream side of the optical fixing device 11 in the advancing direction. The cutter 16 cuts off the recording area of the recording sheet 2, on which the yellow, magenta, and cyan images are thermally recorded, from the following recording area. Moreover, the slitter 17 cuts off the unrecording areas at the both sides of the recording sheet 2. Thereby, the recording sheet 2 from which the unrecording areas are cut off is ejected outside the printer from an ejection slot (not shown) by an ejection roller pair 18.

A controller 10 controls each section of the color direct thermal printer to develop the yellow, magenta and cyan thermosensitive coloring layers in sequence. Moreover, the controller 10 calculates printing heat energy by line when each color image is recorded on the recording sheet 2, driving the heating elements facing the unrecording areas based on the printing heat energy to keep the printing heat energy by line at approximately same value.

The controller 10 includes a frame memory 21, a first line memory 22, an unrecording area printing heat energy calculator 23, a second line memory 24 and a conduction time calculation controller 25.

Image data memorized in the frame memory 21 is transferred to the first line memory 22 line by line. The first line memory 22 memorizes image data for plural lines, for example 5 lines. Image data memorized in the first line memory 22 is transferred to the unrecording area printing heat energy calculator 23 line by line. The unrecording area printing heat energy calculator 23 calculates an unrecording area printing heat energy (second printing heat energy) Esi by subtracting printing heat energy (first printing heat energy) Epi for given number of line in the recording area from maximum printing heat energy Epmax (standard printing heat energy) for printing the recording area (RA) (see FIG. 2). Next, common printing heat energy is calculated by dividing unrecording area printing heat energy by the number of the heating elements positioned in the unrecording area (UA) (see FIG. 2). Virtual image data is counted backward from the common printing heat energy. The virtual image data and the image data of the recording area are memorized in the second line memory 24. Next, the image data and the virtual image data in the second line memory 24 are read out and transferred to the conduction time calculation controller 25. The conduction time of each heating element is calculated according to the number of color tones of each image data. The conduction time data is transferred to a head driver of the thermal head 6. The head driver heats each heating element by the conduction time control data. In synchronism with the drive of the heating elements, rotation of the transporting roller pair 3 is controlled through the driver 4*a* and the transport motor 4, and the image is recorded on the recording sheet 2 line by line.

Figure 2:
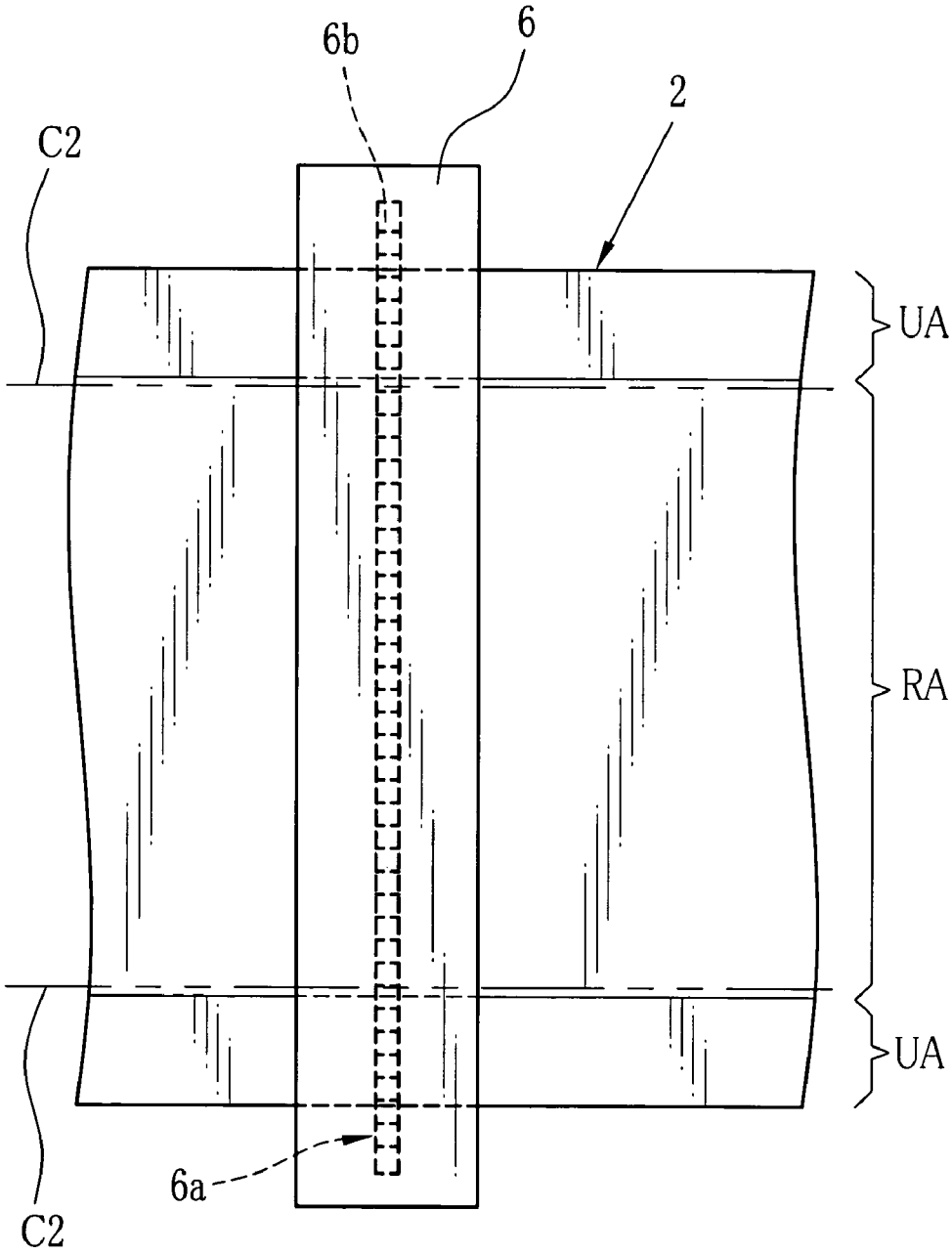
FIG. 2 is an explanatory view illustrating a relation of a heating element array in a thermal head with a recording area and an unrecording area of a recording sheet.

In FIG. 2, a first group is composed of heating elements facing the recording area (RA) and a second group is composed of heating elements facing the unrecording area (UA). Heating elements of the first group are driven by image data and recorded in the recording area (RA) line by line. Heating elements of the second group are driven by the virtual image data.

The operation of the above embodiments are described now. In FIG. 1, for image recording, the recording sheet 2 is transported in the printing direction by the transporting roller pair 3. When the thermal head 6 detects a leading end of the recording sheet 2, the heating element array 6*a* is heated and yellow image of one line is recorded on the yellow thermosensitive coloring layer. Then, the yellow image is recorded line by line simultaneous with transport of the recording sheet 2.

When the image is recorded by line, the unrecording area printing heat energy calculator 23 calculates an unrecording area printing heat energy for the given number of line Esi by subtracting printing heat energy Epi for the given number of line in the recording area from maximum printing heat energy Epmax (standard printing heat energy) on printing the recording area (RA). Next, virtual image data for each heating element is calculated by dividing the unrecording area printing heat energy by the number of the heating elements positioned in the unrecording area. The virtual image data and the image data on the recording area are memorized in the second line memory 24 as image data of one line. Next, image data of one line is read from the second line memory 24 and transferred to the conduction time calculation controller 25 where the conduction time of each heating element is calculated according to the number of color tones of image data. The conduction time data is transferred to the head driver of the thermal head 6. Each heating element is heated by the head driver according to the conduction time controlling data. Simultaneous with the drive of the heating elements, rotation of the transporting roller pair 3 is controlled through the driver 4*a* and the transport motor 4, and the image is recorded on the recording sheet 2 line by line. Thus, total printing heat energy applied from the thermal head 6 becomes constant value at all times when the image data is recorded by line. And there occurs neither fluctuation of dynamic friction coefficient nor the transport load fluctuation due to printing heat energy fluctuation. Therefore, the recording sheet is transported at the constant pitch at all times, there occurs no uneven density resulting from the transport speed fluctuation.

When recording of yellow image for all lines is completed, transport of the recording sheet 2 in the printing direction stops and the recording sheet 2 is transported in the advancing direction. When the recording sheet 2 is transported in the advancing direction, the platen roller 7 is set at the retracted position apart from the thermal head 6 by the shift mechanism. The yellow fixing lamp 12 of the optical fixing device 11 is driven to emit simultaneous with the transport of the recording sheet 2 in the advancing direction, fixing the yellow thermal coloring layer within the recording area of the recording sheet 2. When the optical fixing to the recording area is completed, the transport motor 4 stops.

The recording sheet 2 is reciprocated again, and magenta image recording and fixation are carried out in a manner similar to the yellow color recording. After that, a cyan image is recorded. In magenta and cyan color recording, each heating element corresponding to the unrecording area is driven on the basis of the unrecording area printing heat energy in a manner similar to the yellow color recording.

Figure 3A:
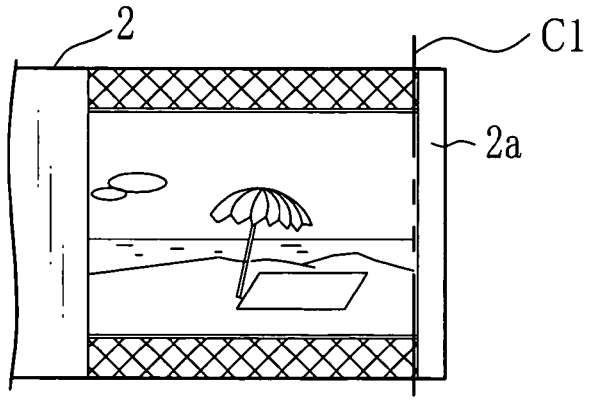
FIGS. 3A to 3D are explanatory views illustrating a process of cutting off a margin at the distal end of the recording sheet and unrecording areas at the upper and lower edges of the recording sheet.
Figure 3B:
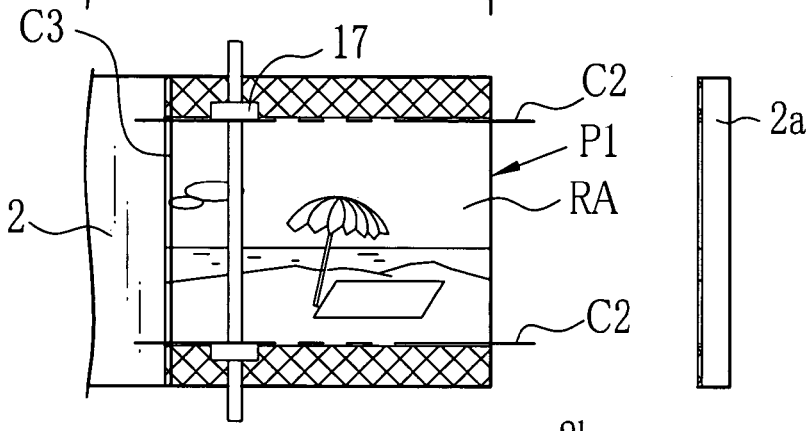
Figure 3C:
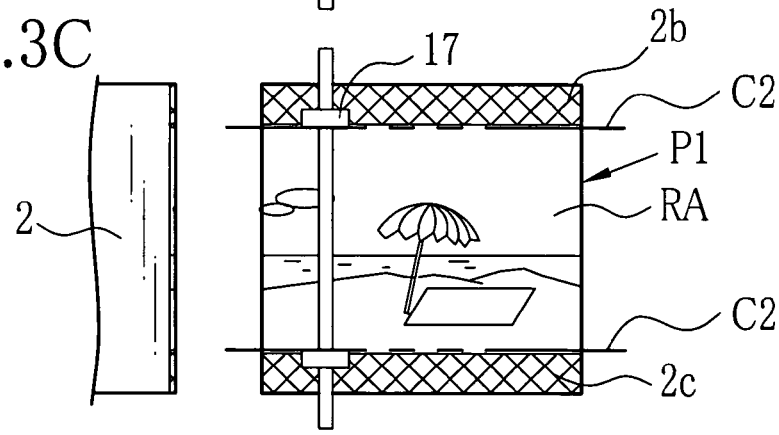
Figure 3D:
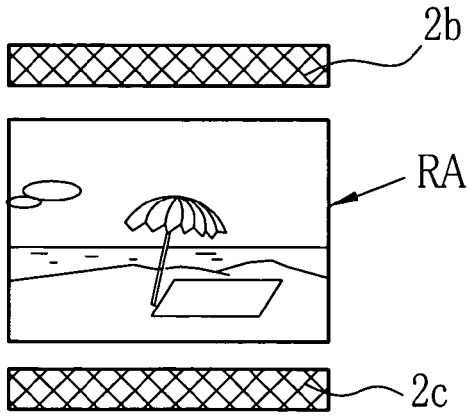

When recording of three color images in a frame sequential manner is completed, the recording sheet 2 is cut at a first cutting line (C1) by a cutter 16 (see FIG. 1) shown in FIG. 3A to cut off the margin 2*a* from the recording sheet 2. Next, as shown in FIG. 3B, the recording sheet 2 is cut at second cutting lines (C2) by a slitter 17 to cut off unrecording portions 2*b* and 2*c* at both upper and lower edges of the recording sheet 2 from the recording sheet 2. In FIG. 3C, the recording sheet 2 is cut at a third cutting line (C3) by the cutter 16 while the slitter 17 is cutting the second cutting lines (C2), and thereby a print (P1) having the recording area (RA) is obtained. Thereafter, the recording sheet 2 is completely cut at the second cutting lines (C2) to cut off the unrecording portions 2*b* and 2*c* at both of the upper and lower edges of the recording sheet 2 from the print (P1) shown in FIG. 3D. Since the printing heat energy is kept constant in each line of the print (P1), there occurs no transport load fluctuation during printing, and an uneven density due to the transport load fluctuation is prevented. In addition, an uneven color does not occur since the three-color images are respectively recorded on identical recording position per line.

It is noted that the recording sheet 2 is cut at the first and third cutting lines (C1 and C3) by the cutter 16 in the width direction and is cut at the second cutting lines (C2) by the slitter 17 in the advancing direction. However types of the cutter 16 and slitter 17 and the cutting order may be optional as long as the margin 2*a* and the unrecording portions 2*b* and 2*c* can be cut off. Moreover, the unrecording portions 2*b* and 2*c* may be cut off by a cutter unit separated from the printer.

Figure 4:
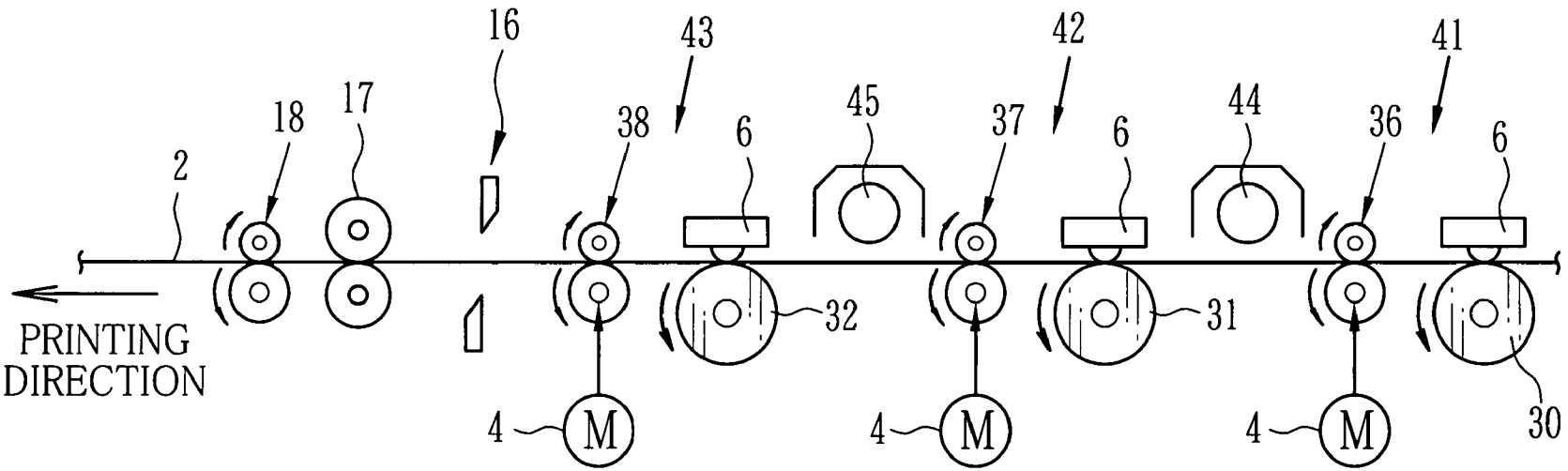
FIG. 4 is a schematic view of another embodiment illustrating a three-heads one-path type color direct thermal printer.

The present invention has been described so far with respect to the above embodiment applied to a one-head three-path type color direct thermal printer, but the present invention is applicable to a three-heads one-path type color direct thermal printer as shown in FIG. 4. It is noted that the same reference numerals will be used to designate the same or similar components as the above embodiment. The numerals 44 and 45 respectively show a yellow fixing device and a magenta fixing device. Also in this case, in the print stages 41 to 43, an unrecording area printing heat energy Esi is calculated by subtracting printing heat energy Epi for the line to be printed in the recording area from maximum printing heat energy Epmax on printing one line in the recording area (RA). Common printing heat energy is calculated by dividing the unrecording area printing heat energy by the number of the heating elements placed in the unrecording area, and virtual image data for each heating element facing the unrecording area (UA) is obtained by counting backward from the common printing heat energy. Image is recorded in both the recording area (RA) and the unrecording area (UA) on the basis of the real image data and the virtual image data. Also in this case, total printing heat energy can be kept approximately constant in each line.

Furthermore, in the above embodiments, maximum printing heat energy Epmax in the recording area (RA) is used as the total printing heat energy, but the value or larger than this (Epmax) may be applicable. Total printing heat energy for one line is effectively determined by using maximum printing heat energy in the printing recording area.

In the above embodiments, the color direct thermal printer is explained. However, the present invention may be used for other types of printers for example a dye diffusion type thermal printer and a wax transfer type thermal printer using yellow, magenta and cyan color ink seats, which have the transport load fluctuation due to fluctuation of printing heat energy by line.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method for recording an image on a recoding sheet line by line by a thermal head, said thermal head including plural heating elements aligned along a main scan direction, said recording sheet being transported in a sub scan direction perpendicular to said main scan direction, said thermal printing method comprising the steps of:

(A) dividing said heating elements into a first group facing a recording area where said image is recorded and a second group facing an unrecording area where said image is not recorded; and (B) driving said first group to record one line on said recording area on the basis of image data of one line, and driving said second group so that total printing heat energy of first printing heat energy generated by said first group and second printing heat energy generated by said second group is approximately made uniform in each line.

2. A thermal printing method as claimed in claim 1, said step (B) further comprising the steps of:

(B1) calculating said first printing heat energy generated by said first group on the basis of image data of one line; and (B2) calculating said second printing heat energy by subtracting said first printing heat energy from total printing heat energy.

3. A thermal printing method as claimed in claim 2, wherein said total printing heat energy is equal to or larger than maximum value of said first printing heat energy.

4. A thermal printing method as claimed in claim 3, said step (B) further comprising the steps of:

(B3) calculating common printing heat energy by dividing said second printing heat energy by the number of heating elements in said second group; and (B4) calculating virtual image data for generating said common printing heat energy, heating elements in said second group being driven according to said virtual image data.

5. A thermal printing method as claimed in claim 4, wherein said unrecording areas are placed at both sides of said recording area.

6. A thermal printing method as claimed in claim 5, further comprising the steps of:

(C) cutting off said unrecording areas from said recording area.

7. A thermal printer for recording an image on a recoding sheet line by line by a thermal head, said thermal head including plural heating elements aligned along a main scan direction, said recording sheet being transported in a sub scan direction perpendicular to said main scan direction, said thermal printer comprising:

a first calculator for calculating first printing heat energy generated by first group line by line from image data of one line, said first group being heating elements facing a recording area where said image is recorded;

a second calculator for calculating second printing heat energy generated by a second group line by line so that total printing heat energy of said first printing heat energy and said second printing heat energy is approximately made uniform in each line, said second group being heating elements to face an unrecording area where said image is not recorded; and a thermal head driving unit for driving said first group according to image data of said one line and driving said second group to generate said second printing heat energy.

8. A thermal printer as claimed in claim 7, wherein said total printing heat energy is equal to or larger than maximum value of said first printing heat energy.

9. A thermal printer as claimed in claim 8, further comprising a third calculator for calculating virtual image data, said third calculator performing the steps of:

calculating common printing heat energy by dividing said second printing heat energy by the number of heating elements in said second group; and calculating said virtual image data from said common printing heat energy, each heating element in said second group being driven according to said virtual data.

10. A thermal printer as claimed in claim 9, wherein said unrecording areas are placed at both sides of said recording area.

* * * * *